United States Patent [19]

Johnson

[11] 4,226,468

[45] Oct. 7, 1980

[54] WALL-CLEARING RECLINER

[75] Inventor: Carl B. Johnson, Pontiac, Ill.

[73] Assignee: Pontiac Furniture Industries, Inc., Pontiac, Ill.

[21] Appl. No.: 885,585

[22] Filed: Mar. 13, 1978

[51] Int. Cl.[3] ..... A47C 1/02; A61G 15/00

[52] U.S. Cl. ..... 297/84; 297/68; 297/83

[58] Field of Search ..... 297/68, 83, DIG. 7, 297/270, 271, 84, 329, 88, 85

[56] References Cited

U.S. PATENT DOCUMENTS

| | | | |
|---|---|---|---|
| Re. 28,210 | 10/1974 | Re' | 297/83 |
| Re. 29,483 | 11/1977 | Re' | 297/88 |
| 58,343 | 9/1966 | Hall | 297/78 |
| 155,187 | 9/1974 | Enger . | |
| 271,512 | 1/1883 | Pursell, Sr. | 297/69 |
| 953,591 | 3/1910 | Bringham | 297/69 X |
| 1,357,130 | 10/1920 | Tse | 297/90 |
| 1,421,260 | 6/1922 | Kurnick | 297/68 X |
| 2,834,397 | 5/1958 | Kluglein et al. | 297/68 |
| 3,243,226 | 3/1966 | Katz | 297/DIG. 7 |
| 3,295,885 | 1/1967 | Barksdale | 297/84 |
| 3,322,459 | 5/1967 | Hampton | 297/DIG. 7 |
| 3,730,585 | 5/1973 | Rogers | 297/DIG. 7 |
| 3,858,932 | 1/1975 | Crum et al. | 297/83 X |
| 3,869,169 | 3/1975 | Johnson et al. | 297/84 |
| 3,958,827 | 5/1976 | Re' | 297/85 X |
| 4,057,289 | 11/1977 | Jones | 297/DIG. 7 |
| 4,077,663 | 3/1978 | Cycowicz et al. | 297/83 |
| 4,092,041 | 5/1978 | Landry | 297/DIG. 7 |
| 4,099,776 | 7/1978 | Crum et al. | 297/68 X |

FOREIGN PATENT DOCUMENTS 598504 6/1934 Fed. Rep. of Germany .

*Primary Examiner*—James T. McCall

*Attorney, Agent, or Firm*—Fitch, Even, Tabin, Flannery & Welsh

[57] ABSTRACT

Disclosed is a reclining chair which moves forward on its base coincidentally with the extension of the self-contained retractable footrest to provide clearance behind the chair for the unobstructed recline of the backrest of the chair.

The forward movement of the footrest and of the chair as a whole is self-propelled by energy previously stored in the mechanism by the occupant's retraction of the footrest by flexing the knees.

18 Claims, 20 Drawing Figures

1a. 1b. 1c 1d.

WALL-CLEARING RECLINER

This invention relates to reclining chairs.

In certain of its aspects it relates to wall-clearing recliners, i.e., the kind of recliner which is movable forwardly on its supporting base to prevent the backrest while reclining from striking the wall or other object near which the back of the chair may be positioned. In certain of its physically lesser aspects, it relates to a legrest extension mechanism which has application to reclining chairs of various types.

In most of the wall-clearing reclining chairs marketed prior to the advent of the slant-track wall-clearing recliner disclosed in U.S. Pat. No. 4,072,342, issued Feb. 7, 1978 on my application jointly with Henry James, the forward movement of the chair body upon its supporting base was derived from the reclining movement of the backrest of the chair in a coordinated action which moved the chair body forward to maintain a satisfactory clearance between the backrest and the wall.

In such chairs, however, the energy for the coordinated forward movement of the chair body is also derived from the recline of the backrest. This dependence makes such chairs difficult to adjust, and gave rise to the departure disclosed in the aforementioned U.S. Pat. No. 4,072,342 in which the chair body is carried forward effortlessly by gravity to provide the necessary clearance to permit the backrest to recline without striking the wall behind the chair.

In the wall-clearing recliner of U.S. Pat. No. 4,072,342, the footrest is extended manually by the use of a side-mounted lever on the arm of the chair. The manipulation of the lever serves also to disable a latch which normally secures the chair body in the usual sitting position, i.e., fully rearward on its base, to permit the chair body to move forward by gravity.

In the chair of the present invention, in contrast, the extension of the footrest from the chair body is powered by stored energy and is synchronized with the forward movement of the chair body as a whole upon its supporting base, one movement being derived from the other in an effortless forward propulsion of the chair body upon its base, no side-mounted lever being necessary to operate the footrest.

The invention is explained in the following detailed description made in reference to the accompanying drawings, in which.

Figure 1:
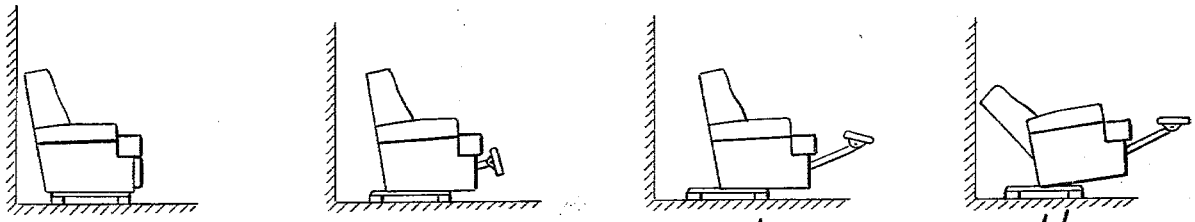
FIG. 1 is a series of four cartoons, a., b., c., and d., which illustrate the sequence of movements of the chair from the upright sitting position to the reclined position.
Figure 2:
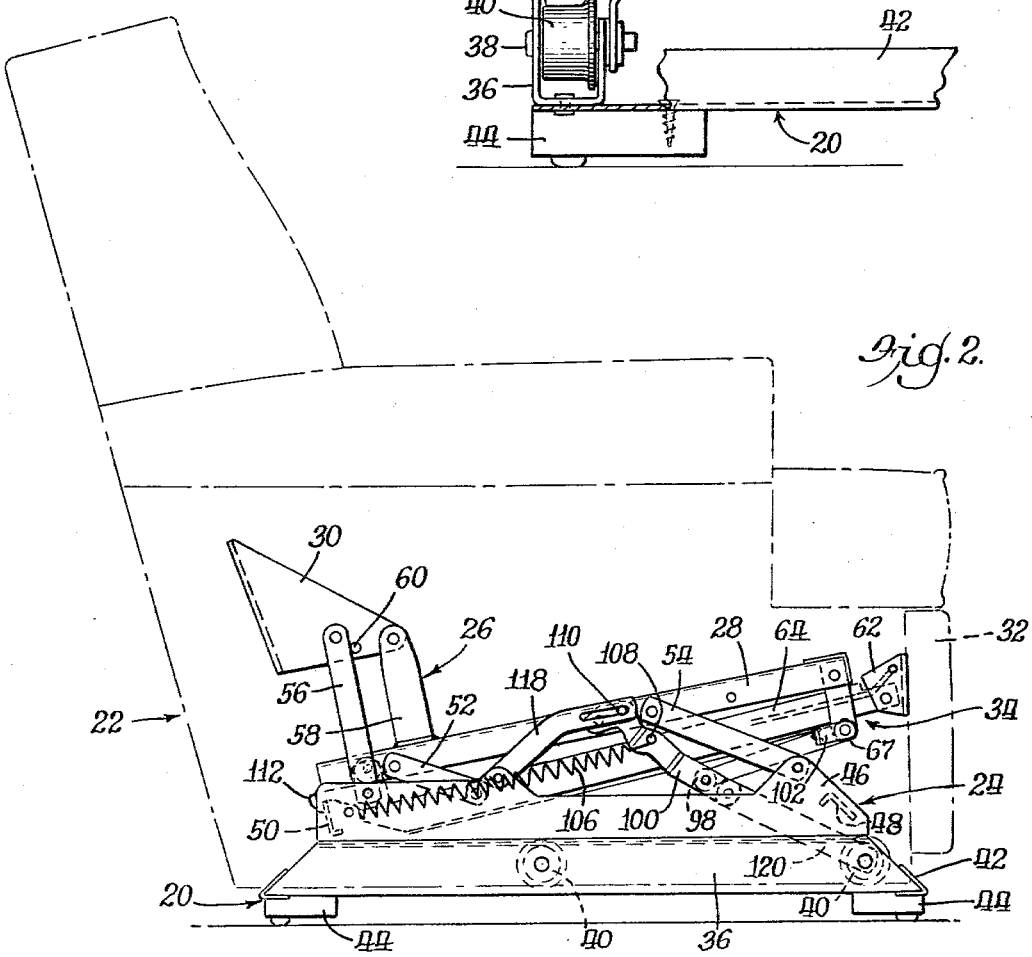
FIG. 2 is a side elevation of the chair of the invention with the chair base, movable carriage, and linkage mechanisms shown in full line and upholstered portion of the chair in broken outline, the chair being shown in the sitting position, corresponding to the cartoon of FIG. 1*a;*
Figure 4:
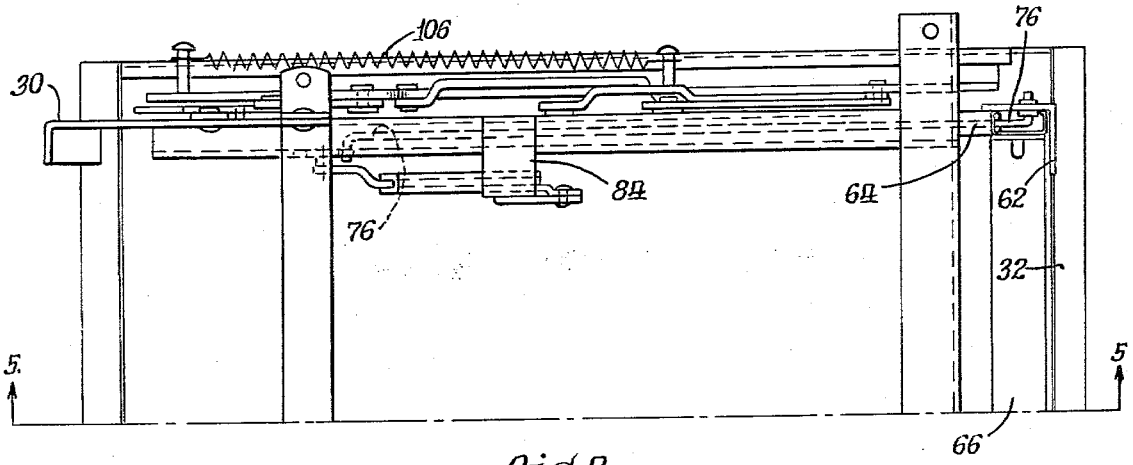
FIG. 4 is a top view of the left side of the base, carriage and mechanism shown in FIG. 1, the same being broken on the center line of the chair.
Figure 5:
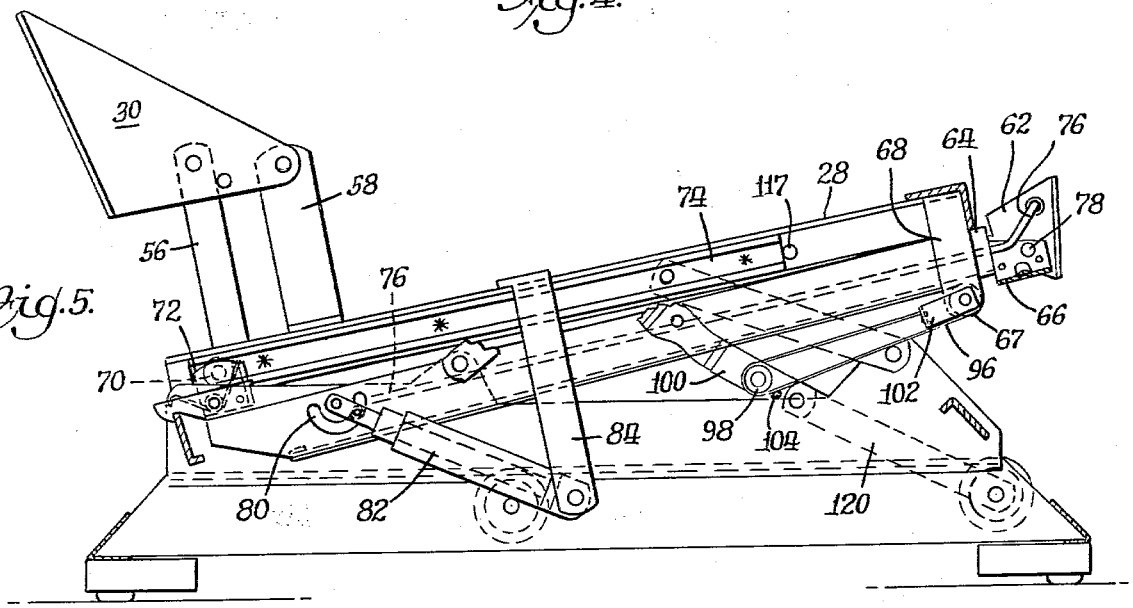
FIG. 5 is an interior view of the mechanism taken as a section on the center line, 5—5, of FIG. 4.
Figure 6:
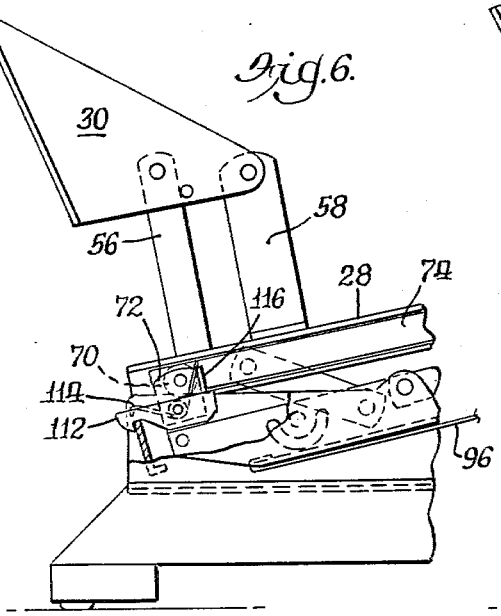
Figure 6A:
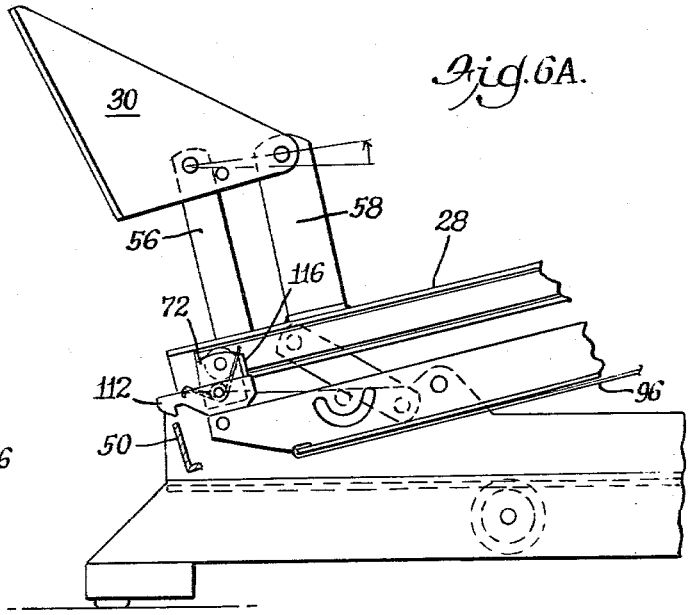
Figure 7:
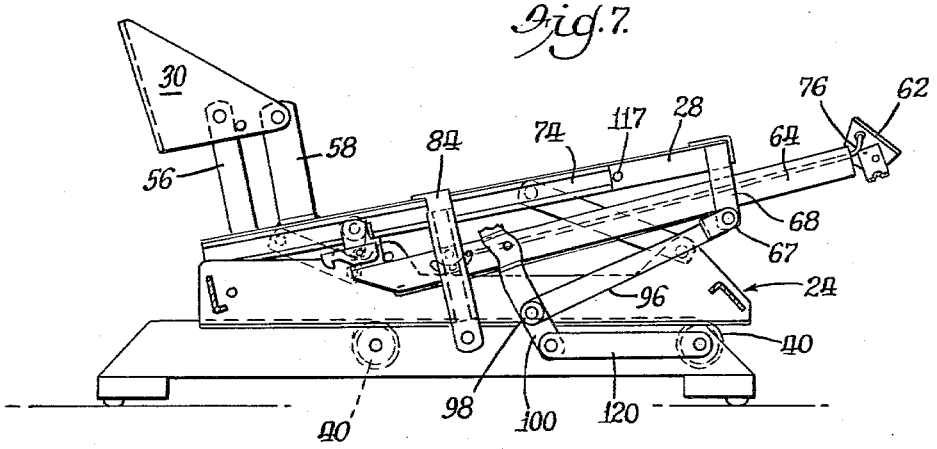
Figure 7A:
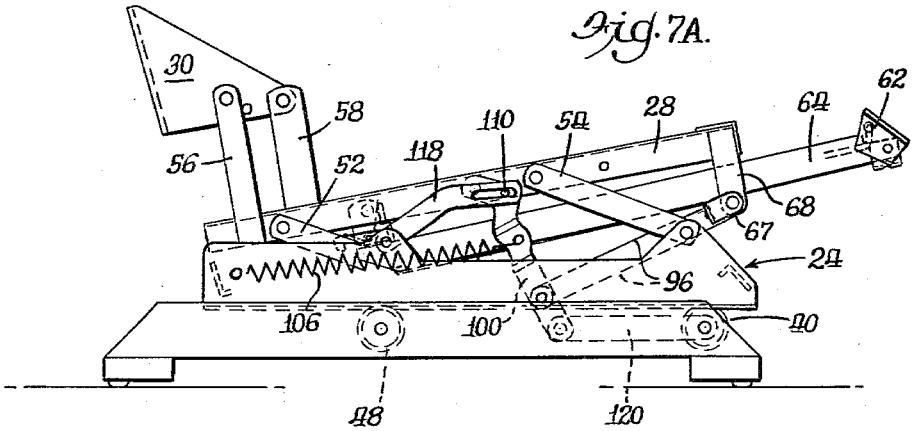

FIGS. 6 and 6*a* are enlarged fragmentary interior elevations of the mechanism, as shown in FIG. 5, with certain parts broken away to better illustrate the operation of the extension latch;

FIGS. 7 and 7*a* are elevational views of the chair mechanism, comparable respectively to FIGS. 5 and 2, but illustrating the footrest and the carriage in an intermediate stage of extension or retraction corresponding to the cartoon of FIG. 1*b;*

Figure 8:
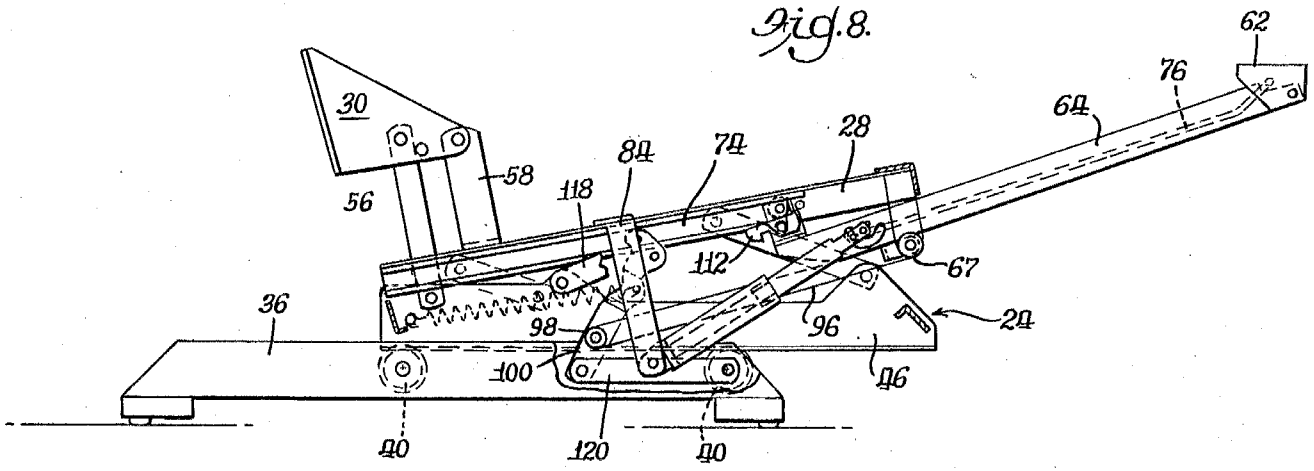
Figure 8A:
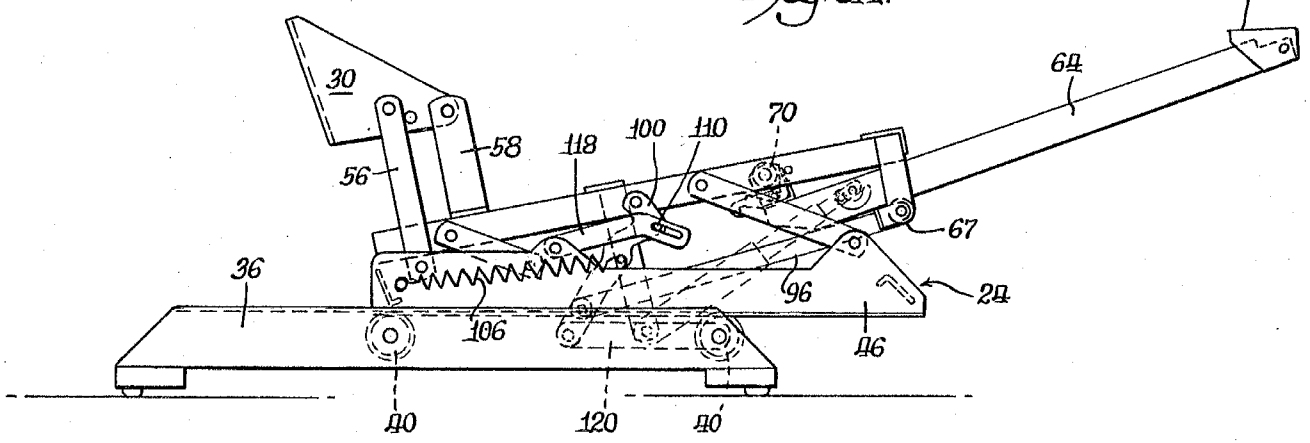

FIGS. 8 and 8*a* are side elevational views of the chair mechanism comparable to FIGS. 7 and 7*a,* illustrating the mechanism with the carriage fully advanced on the chair base and with the footrest fully extended in front of the chair body, as at the end of the forward movement or the beginning of the return movement, and corresponding to the cartoon of FIG. 1*c;*

Figure 9:
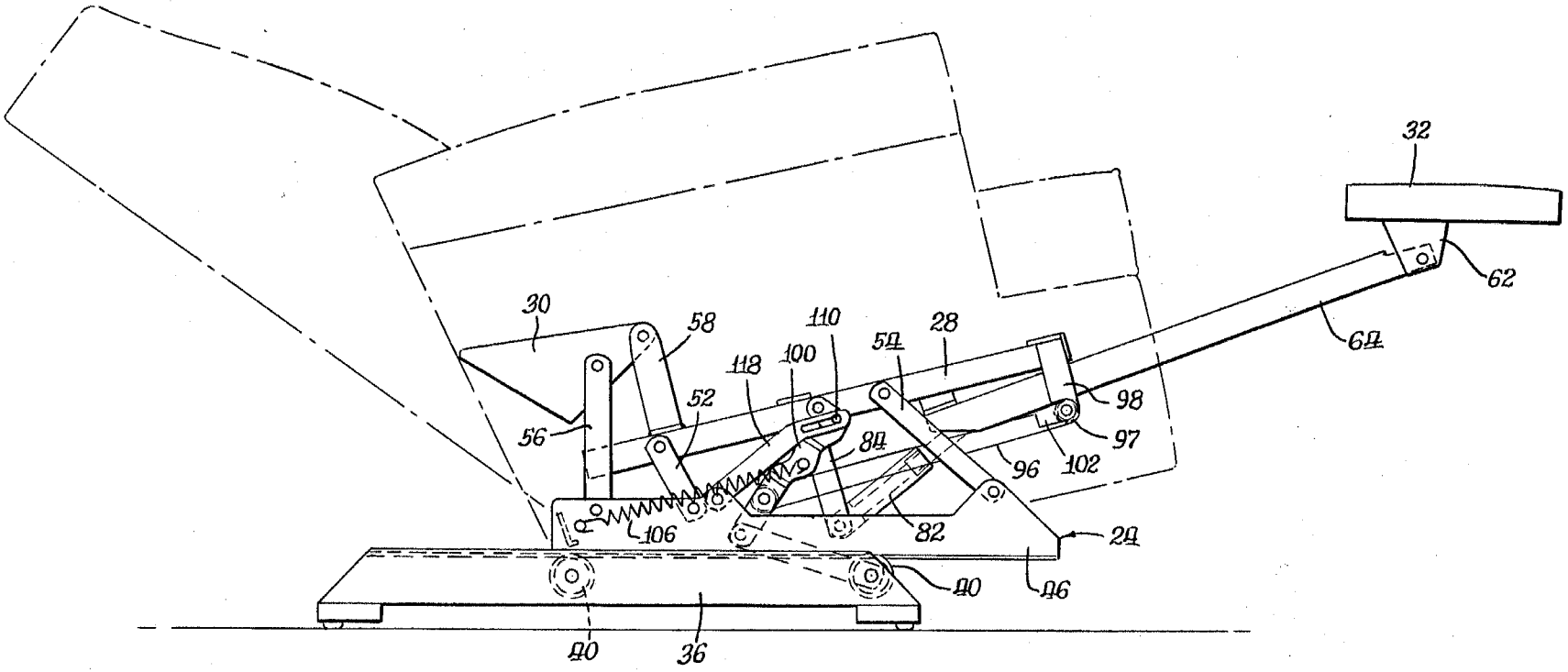

FIG. 9 is a side elevational view of the chair similar to FIG. 2 but showing the chair body fully advanced on the base, with footrest extended and backrest reclined, corresponding to the cartoon of FIG. 1*d;*

Figure 10:
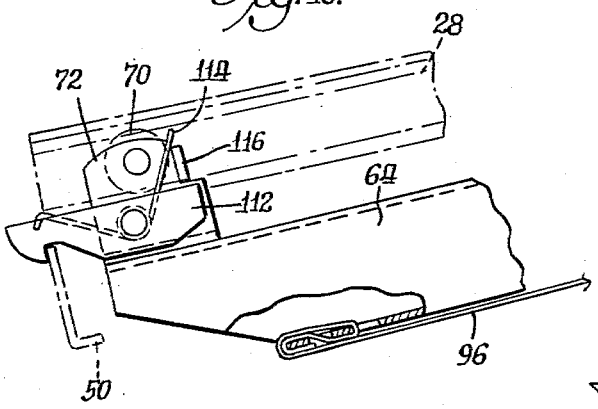
Figure 10A:
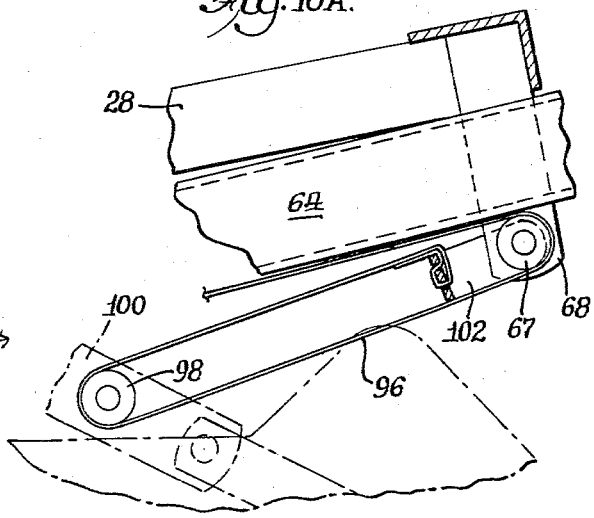
Figure 15:
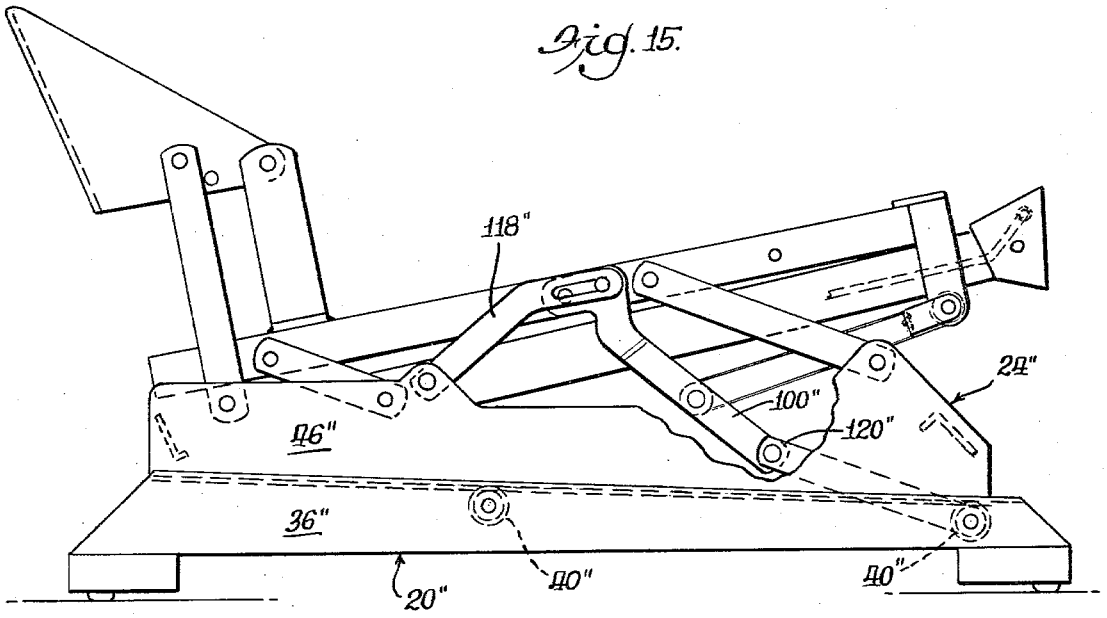
Figure 16:
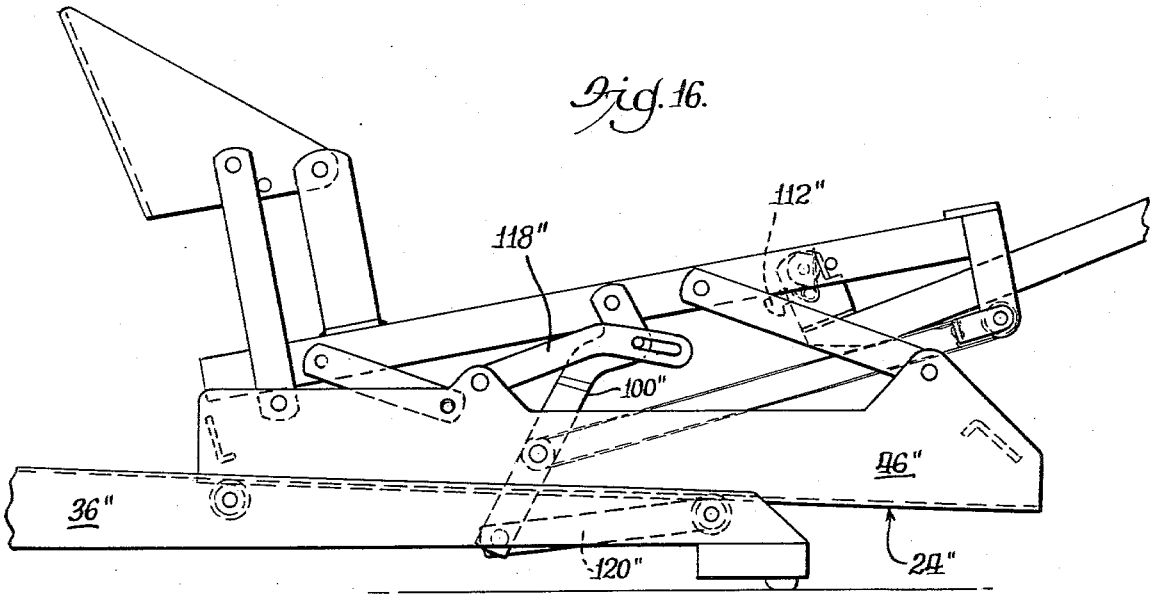

FIGS. 10 and 10*a* (Sheet 3) are fragmentary elevational views, partly in section, to illustrate certain details of the drive mechanism for advancing the footrest and the chair body;

FIGS. 11 to 14 inclusive are fragmentary elevational views of the chair mechanism with a modified form of driving connection between the carriage and the stationary chair base;

FIGS. 15 and 16 are fragmentary elevational views of a second modified form of the chair of the invention, in which the driving force to extend the footrest and to propel the carriage forwardly is applied to the carriage, and incidentally takes the form of gravity.

SUMMARY OF INVENTION

As earlier mentioned, the wall-clearing chair of the present invention uses stored energy to extend the footrest, and, in the process, to move the chair body forward effortlessly on the chair base.

In all of its disclosed embodiments, the energy is stored by the occupant's retraction of the footrest with the relatively powerful thigh muscles, and later employed to extend the footrest and to bring the chair forward on its track.

In the preferred embodiment and in one of the modifications disclosed, the forward propulsion of the chair body is provided by a spring or springs connected to extend the footrest. However, as other disclosed modifications demonstrate, the broader purpose of extending the footrest and propelling the chair body forwardly with stored energy, whatever its form, can also be accomplished by applying the forward driving force to the chair body instead of the footrest, in which case the stored energy may conveniently take the form of gravity as an alternative to the use of springs.

I. THE PREFERRED EMBODIMENT, FIGS. 1 TO 10

Inasmuch as the chair mechanism, although a cooperating whole, may be regarded as a series of interrelated mechanisms, it is helpful to an understanding of its operation to point out what may be regarded as constituent subassemblies.

In the broadest sense, the constituent parts include the base 20 of the chair, which rests upon the floor and is normally stationary throughout all phases of adjustment of the chair, and a chair body 22 which is movable forwardly and rearwardly on the base. The chair body, in turn, comprises a sub-base in the form of a carriage 24 which is roller-mounted upon the chair base, a recline mechanism 26 which includes the seat frame 28 and the backrest brackets 30, their connections with each other, and their movable mountings on the carriage, and a retractable footrest 32 and its associated operating mechanism 34, which in the illustrated case are underslung from and supported by the seat frame 28 of the chair.

The Normally Stationary Chair Base 20

The base 20 of the chair is constructed almost entirely of metal. It comprises a pair of side rails 36 which are formed of sheet steel in the shape of a relatively deep and narrow upwardly-open channel whose outer leg is taller than the inner leg and turned inwardly as a horizontal flange of approximately one-third of the width of the channel web (see FIG. 3). The opposed flanges of each channel provide mountings for the axle pins 38 of two single-flange rollers 40, one at the front of the rail and one located somewhat rearwardly of mid-length, upon which the carriage 24 of the chair body rests and moves forward and back. The ends of the two side rails 36 have a sloped profile, and the corresponding ends of the rails are cross-connected by a pair of cross members 42 which are likewise formed of metal sheet and bent longitudinally to an acute angle conforming to the end profile of the side rails. The cross members 42 and the side rails 36 are joined by rivets to form a frame which is rectangular in plan and supported at each of its corners by an elevating block 44 of wood or plastic which is secured to the frame corner by means of screws and is preferably provided with a glide to facilitate its movement on a carpeted floor.

The Carriage 24

The movable carriage of the chair body is likewise rectangular in plan and comprises a pair of angle-shaped side plates 46 which are cross connected at front and back by angle-shaped cross members 48 and 50 also formed of sheet metal. The side plates 46 and the cross members of the carriage are joined together in a tab-and-slot connection, i.e., the side plates are punched to provide rectangular slots which receive mating tabs formed on the ends of the cross members to position the parts for ready assembly, which is maintained either by deforming the tabs after assembly or by tack welding the cross members and side plates to each other.

Figure 3:
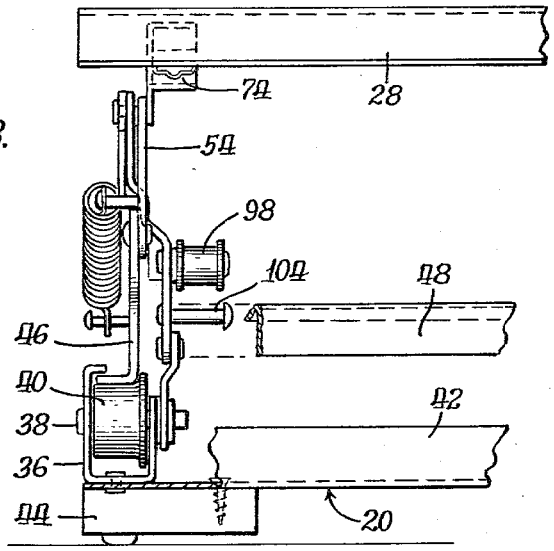
FIG. 3 is a fragmentary front view of the mechanism of FIG. 2 with the footrest and its supports removed, and with parts broken away to improve the illustration of the carriage mounting.

The two legs of the angle-shaped side plates 46 of the carriage are bent at a generous radius to provide a short horizontal leg which constitutes the track surface which supports the carriage on the rollers 40, which are flanged only on their inwardly facing sides, and provided with a generous fillet to match the bend radius of the side plates 46. In FIG. 3 it will be seen that the lower, horizontal leg of the side plates of the carriage underlies the inwardly extending flange of the side rail 36 of the base frame so that the carriage and base, when assembled, are interlocked against disengagement when the chair is lifted by the chair body.

Although the two cross members 48 and 50 of the carriage have the same shape for economy of manufacture, the front cross member 48 is mounted with the apex of the angle facing upwardly and its longer leg disposed to conform to the common slope at the front ends of both the side plate 46 of the carriage and the side rail 36 of the stationary base. At the rear of the carriage, the apex of the angle member 50 is at the bottom of the member with the long leg of the angle extending upwardly to provide a convenient cooperating edge for a latch hook, still to be described, of the footrest extension mechanism.

The upstanding vertical leg of each side plate 46 of the carriage is sufficiently tall throughout its length to provide adequate beam strength for the concentrated reaction loads received from the rollers 40 on which the carriage is mounted, and is otherwise shaped to provide appropriate sites for the mounting of the chair recline mechanism on the carriage, and clearances, as necessary, for the operation of the various relatively movable parts.

The Recline Mechanism 26

The specific form of recline mechanism 26 here disclosed is not of itself a part of the invention here claimed, but is the subject of my copending United States application Ser. No. 885,586 filed Mar. 13, 1978. For purposes of the present invention, other specific forms of recline mechanism can be used, as will subsequently become clear.

The seat frame 28 of the chair, devoid of cushion springs and upholstery, is essentially a rectangular metal frame having angle-iron side and front rails and a rear cross member of flat bar stock. The seat frame 28 is movably mounted on the carriage 24 by two links 52 and 54 which join the side rails of the seat frame and the carriage side plates in a four-bar linkage at each side of the chair.

In the sitting position of the chair, the attitude of the several parts is as shown in FIGS. 2 to 5 inclusive, from which it will be seen that, in that position, the seat suspension links 52 and 54 are approximately parallel and extend rearwardly and upwardly from their pivotal connections to the carriage side plate 46 to their pivotal connections to the side rail of the seat frame. It will also be observed, however, that the front link 54 is substantially longer than the rear link 52 so that the relative movement of the seat of the chair upwardly and forwardly with respect to the carriage, upon recline of the backrest, increases the pitch of the seat because the front of the seat frame rises faster than the rear.

The backrest of the chair body is supported at each side by the bracket 30 connected to the side plate 46 of the carriage by a single vertical link 56. Each backrest bracket is also pivoted to a riser bracket 58 fixed to the seat frame 28 near the rear thereof and standing in front of the backrest support link 56 at each side of the chair. It will be appreciated that, in this arrangement, the back support link 56 serves as a movable jacking strut, and that the backrest of the chair serves during recline as a lever, turning on the upper pivot of the support link 56 as a fulcrum, to lift the seat frame 28. The seat frame, however, is guided through a fixed path of upward and forward movement on the carriage by virtue of its two supporting links 52 and 54, and the lower end of the backrest therefore follows the seat forwardly as its upper end reclines rearwardly, with the back support link 56 following the forward movement of the lower end of the backrest (see FIG. 9).

The normal sitting position, illustrated in FIG. 2, is determined by a stop rivet 60 on the backrest bracket 30 positioned to engage the forward edge of the back support link 56. While all of the principal load-carrying pivot rivets are preferably bushed for ease of operation and to reduce the friction and wear at the pivots, the position of the stop rivet 60 is selected to maintain all joints under load in the sitting position to eliminate rattle or other noise if wear at the joints should nevertheless be experienced.

The Footrest Mechanism 34

Insofar as the support of the footrest is concerned in its movement to and from the extended position, and its support while in the extended position, the footrest of the disclosed embodiment is substantially the same as that of U.S. Pat. No. 3,869,169, assigned to the assignee of this invention. That is, the footrest 32 is mounted on pivot brackets 62 at the front end of two parallel tubular rails 64 of rectangular section which are connected by a cross bar 66 at their front ends, and are mounted on the underside of the seat frame (see FIGS. 4 and 5). Each rail is supported at the front of the seat frame upon a roller 67 journalled on a bracket 68 depending from the front edge of the seat frame 28, and at its rear end by a second roller 70 which is journalled on a bracket 72 extending upwardly from the back end of the rail. The second roller 70 travels back and forth in a confining channel-shaped track 74, secured to the inside of the angle-iron side rail of the seat frame 28 (FIGS. 3 and 6), as the footrest is retracted and extended.

The attitude of the footrest at the front ends of the two supporting rails 68 is changed from the vertical, when the footrest is retracted, (FIG. 5), to an upwardly facing angular position when the footrest is extended (FIG. 8). Also, as disclosed in U.S. Pat. No. 3,869,169, this angular adjustment is effected gradually, as an incident to the extension of the footrest, by a link rod 76 which is housed within the tubular rail. At its front end, the link rod is bent upwardly and sidewardly for pivotal connection to the footrest pivot bracket 62 above the axis of the bracket's pivot 78 to the rail. It is also bent sidewardly at its rear end to protrude through an arcuate slot 80 in the rail for pivotal connection to a telescopic adjusting link 82, one part of which is pivoted to the tubular rail 64 at the center of the arc of the slot 80. The cooperating lower part of the telescopic link 82 is pivoted to a bracket 84 which is secured to and extends downwardly from the seat frame 28 about midway thereof from front to back. The lower part of the telescopic link is a channel-shaped section offset from its pivotal connection to the bracket 84 while the upper part is formed as a flat bar slideable in the channel, and narrowed and offset from its pivotal connection to the rail 68 to permit maximum shortening of the link 82 as it passes over its pivotal connection to the bracket 84.

Thus, as the rail 64 is propelled forwardly by other means, the telescopic link 82 (compare FIGS. 5, 7 and 8) draws the link rod 76 rearwardly in the footrest support rail to rotate the footrest upwardly as it is extended. Upon retraction of the footrest (FIG. 8 to FIG. 5) the reverse action occurs, folding the footrest down as it is retracted. The telescopic adjusting link 82 is employed only on one side of the chair (the left, FIGS. 5, 7 and 8).

The Footrest and Carriage Drive

In describing the rails 64 on which the footrest is supported and transported, reference already has been made to the rollers 67 which are journalled on the brackets 68 at the front of the seat frame to engage the undersurface of the footrest support rails. In the present invention, those rollers are also employed as sheaves for a flexible band or tape 96 which may be of steel, plastic, or other suitable material, which and is anchored to the footrest support rail 64 at its back end (FIG. 10). The tape extends forwardly beneath the tubular rail and passes around the forward support roller 67 as a sheave. It then extends rearwardly to pass around a second sheave 98 which is mounted on a depending dogleg arm 100 pivoted on the side member of the seat frame 28 at approximately mid-length. After passing around the second sheave, 98, the tape extends forwardly and is anchored in a U-shaped clip 102 pivoted to the axle pin of the forward roller-sheave (FIG. 10*a*).

FIGS. 10 and 10*a* illustrate how a bight at each end of the tape 96, always in tension, is threaded through two spaced slots in the rear end of the tubular rail 64 and in the anchor clip 102 to secure a plastic tape to those members by friction. A guard pin 104 maintains the tape on the sheave 98.

It will be appreciated, therefore, that when the dogleg arm 100, hereinafter called "the drive arm," is hauled rearwardly about its pivotal connection to the seat, the tape 96 draws the footrest support rails 64 forwardly to project the footrest a distance twice the net rearward travel of the sheave 98.

The force for drawing the drive arm 100 rearwardly of the seat frame to project the footrest is supplied by a driving tension spring 106 which is stretched between a shoulder rivet 108 on the movable drive arm and a similar rivet on the vertical flange of the side plate 46 of the carriage. In the illustrated mechanism, the spring 106, of which there is one at each side of the mechanism, is tensioned to have an initial pull of magnitude such that, as reduced by the use of the second sheave or "block" 98 and by the mechanical advantage of the sheave placement on the drive arm 100, it can on the one hand be readily supplied by the occupant of the chair in flexing his knees to retract the footrest with his heels, and, on the other, will not accelerate the chair and occupant unduly in their forward movement. The magnitude of the spring force is related to yet another function of the spring which is discussed later herein.

The dogleg shape of the drive arm 100 results from the desired placement of the spring anchoring rivet 108, and a stop rivet 110, forwardly of a line between the pivot of the drive arm to the seat frame and the axis of the sheave 98, for purposes later to be described, and the provision of suitable offsets for necessary clearances between the relatively movable parts.

The footrest is normally maintained in the retracted position by means of a pair of latch hooks 112 located at the rear ends of the footrest support rails 64 on the upstanding brackets 72 which journal the rear rail-supporting rollers 70. Each latch hook is pivoted on a shoulder rivet on the roller bracket 72, and is biased downwardly by a torsion spring 114 one arm of which is hooked over the top of the latch hook and the other of which is bucked by a tab 116 struck inwardly from the roller bracket 72 (FIGS. 6 and 10). The tab 116 also serves, by its engagement with the extension of the shank of the hook from the hook pivot, to limit the downward rotation of the hook to the position illustrated in FIGS. 5, 6, and 10. When the footrest nears full retraction, the cam-shaped nose of the latch hook rides up and over the vertical leg of the rear cross member 50 of the carriage until the latch hook, urged downwardly by the torsion spring, drops behind the cross member to secure the footrest, and the chair body, in the retracted position.

The release of the latch 112 is effected by a slight rearward movement of the backrest 30, as though to recline the chair (FIG. 6 to FIG. 6*a*). This slight rearward movement of the backrest, by means of the backrest supporting mechanism earlier described, provides a direct-jacking lift of the seat frame 28, and frees the latch hook 112 from its engagement with the rear cross member 50 of the carriage. When that occurs, the drive spring 106 draws the drive arm 100 rearwardly, which in turn, through the medium of the flexible tape 96, hauls the footrest supporting rails 64 forwardly to extend the footrest 32 to the limit determined by the engagement of the tab 116 on the footrest rail roller-bracket 72 with the stop rivet 117 at the front end of the roller channel 74.

To prevent any more than a slight rearward movement of the backrest 30 from the sitting position before the chair body 22 has moved forwardly on the base 20, a positive stop is provided in the form of a forwardly-extending slotted interlock link 118 pivoted to the side plate 46 of the carriage and encompassing the stop rivet 110 in the drive arm 100. It will be noted that, in the sitting position (FIGS. 2 and 6) and with the footrest retracted, the stop rivet 110 is near but not at the forward end of the slot in the link 118. When the backrest is pushed slightly rearwardly, however, (FIG. 6*a*), the seat frame 28 moves forwardly as well as upwardly, shifting the stop rivet 110 toward the forward end of the slot in the link 118 as a limit. Moreover, until the accompanying upward movement of the seat frame frees the latch hooks 112 from the rear cross member 50 of the carriage, the footrest support rails 64 cannot move forwardly and the resulting relative movement of the seat frame forward with respect to the footrest support rails also draws the drive arm 100 forwardly relative to the link 118. These two additive causes move the stop rivet 110 to the forward end of the slot in the stop link to limit the recline of the back to that slight degree of rearward movement necessary to disengage the latch hooks 112. The footrest is thereupon driven forwardly by the contraction of the drive spring 106, and, by means now to be described, the chair body 22 as a whole moves forwardly on the chair base 20 in a movement coordinated with the extension of the footrest.

In the preferred form of the invention illustrated in FIGS. 2 to 10 inclusive, the distal end of the drive arm 100 is connected to the base 20 by a toggle link 120 which is pivoted to the base frame by being journalled on the axle pin of the forward carriage support roller 40. It will be appreciated, therefore, that when the footrest retaining latches 112 are disabled and the drive springs 106 draw the drive arms 100 rearwardly on the seat frame, the rotation of the drive arm under the force of the drive spring hauls the carriage forward on its supporting rollers in a movement synchronized with the extension of the footrest.

Returning for a moment to the slotted interlock link 118, it will be seen from FIGS. 7*a* and 8*a* that the action of the drive spring 106 in drawing the drive arm 100 rearwardly draws the stop rivet 110 rearwardly in the slot of the stop link 118, which frees the backrest of the chair for full recline when the footrest is fully extended. The movement of the backrest into full recline is accompanied, as earlier indicated, by the forward and upward movement of the seat frame 28 relative to the carriage 24, which again moves the stop rivet 110 on the drive arm 100 to the forward end of the slot in the link 118 (see FIG. 9), even though the drive arm is in its rearward position, i.e., with the footrest fully extended.

The placement of the stop rivet 110 at the front end of the slot in the interlock link when the backrest is reclined serves the further purpose of preventing the retraction of the footrest, and the accompanying rearward movement of the chair body, unless the backrest, if reclined, is also raised either as a preliminary or a coordinated movement. Thus, if a force sufficient to retract the footrest in those circumstances were applied, the slotted interlock link 118 would serve as a fulcrum for the stop rivet 110 on the drive arm, which would then, acting as a lever, haul the seat frame 28 rearwardly on the carriage, and forcibly erect the backrest. However, inasmuch as it is difficult for the occupant of the chair to flex his knees to retract the footrest without also releaving the pressure of his weight against the backrest, the natural inclination is first to restore the chair to the sitting position before or while retracting the footrest to propel the chair rearwardly, the interlock link 118 serving merely to monitor the action to prevent the backrest from striking the wall under any circumstances.

The rearward movement of the carriage 24 on the chair base 20 is likewise effected by movement of the drive arm 100 relative to the seat frame by the occupant's act of retracting the footrest by flexing his knees. Specifically, when the footrest 32 is forced inwardly, the tape 96 underlying the footrest rail 64 is drawn to the rear around the front support rollers 67 which in turn draws the drive arm 100 forward relative to the seat frame against the force of the drive spring 106 until the footrest is again latched in the retracted position. The forward movement of the sheave arm 100 relative to the seat frame, and thus to the carriage 24, serves, through its connection to the chair base by the toggle link 120 to propel the chair body rearwardly to the normal sitting position of the chair.

The particular placements of the spring anchoring rivet 108 and the stop rivet 110 well forward of the axis of the drive arm 100 may now advantageously be noted. The drive spring 106, as earlier noted, is a coiled-wire tension spring stretched to its maximum tension in the sitting position of the chair (FIG. 2) in order to propel the chair forward, and to extend the footrest, upon the release of the footrest latches. In order to compensate for the variation in the spring force throughout the swing of the drive arm 100, the spring anchoring pin 108 on the drive arm 100 is placed so as to offset the increase in the spring force by concurrently reducing the effective moment arm of the spring. This is particularly useful in assuring that the footrest latches 112 can be readily re-engaged without any special effort on the part of the occupant in retracting the footrest.

The stop rivet 110 is similarly placed well forward of the axis of the drive arm so that the rearward movement of the stop pin 110 in the slot of the interlock link 118 is slight during the first half of the rearward swing of the drive arm 100 to extend the footrest, and occurs largely in the latter half of that swing. Conversely, considered in relation to the retraction of the footrest, substantially the entire movement of the stop pin 110 in the slot of the interlock link 118 occurs in the first half of the retraction movement of the footrest, the net effect being to prevent the recline of the backrest until the extension of the footrest and the forward movement of the chair are at least half completed, the slotted link thereafter permitting substantial recline of the backrest only as the second half of the forward movement of the chair proceeds.

The Multiple Functions of the Drive Spring 106

Inasmuch as it is contemplated that the recline mechanism and the footrest extension mechanism can and will be utilized in reclining chairs other than wall-clearing recliners per se, e.g., rocker recliners for example, the multiple function of the drive spring 106 should be recognized for its utility in preventing reclining movement of the backrest until the footrest is extended, quite independently of the action of the interlock link 118. In a rocker-recliner, the ability of the chair body to rock when sat in abruptly greatly reduces the likelihood that the footrest will be released inadvertently, and the requirement for space to the rear of the chair in order to permit rocking eliminates any need for concern that the backrest will strike the wall when reclined, i.e., eliminates any need for the positive interlock of the slotted link 118, the drive spring 106 providing adequate control of the sequence of operation of the footrest and backrest.

Specifically, it will be observed that the drive spring 106 is at maximum tension when the footrest is retracted. Thus, inasmuch as any recline of the backrest is accompanied by forward and upward movement of the seat frame 28, the drive spring 106 resists the recline of the backrest, and does so with substantial force. This force, in turn, is dissipated upon the contraction of the drive spring 106 in extending the footrest, so that the drive spring also serves as an interlock or sequence controller, essentially requiring the extension of the footrest before the backrest can be reclined, an important feature in the application of the invention to rocker recliners.

Conversely, the reclining of the backrest with the footrest extended re-tensions the drive spring 106, substantially preventing the retraction of the footrest while the backrest is reclined, and requiring the righting of the backrest as a preliminary to the retraction of the footrest.

In the disclosed context, therefore, the drive spring 106 provides automatic sequencing, requiring that the footrest be extended before the back can be reclined and conversely that the backrest be righted either concurrently with or preliminarily to the retraction of the footrest.

II. THE MODIFICATION OF FIGS. 11 TO 14

While the chair of the invention has been described in its broader sense by reference to the preferred form of FIGS. 2 to 10 incl., in which the forward movement of the chair body is synchronized with the extension of the footrest throughout the movement of both by means of the rigid toggle link 120 which connects the drive arm 100 with the stationary base 20, it will be appreciated that this reversible application of force to the carriage of the chair body may also be accomplished by flexible connections between the base frame and the end of the drive arm. Some interesting and pleasant effects can be attained, moreover, by making those connections resilient as well as flexible.

Figure 11:
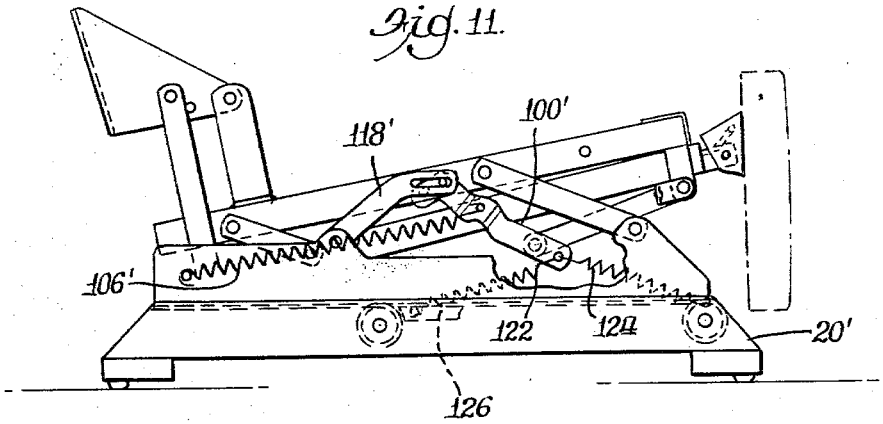
Figure 12:
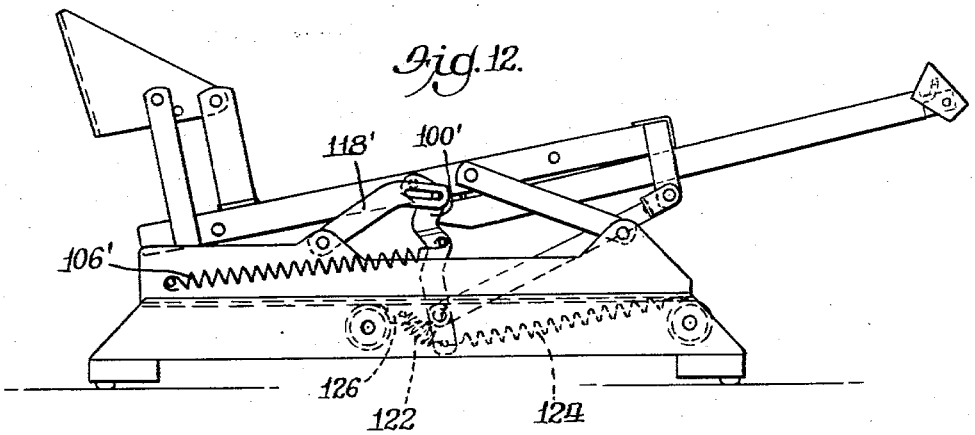
Figure 13:
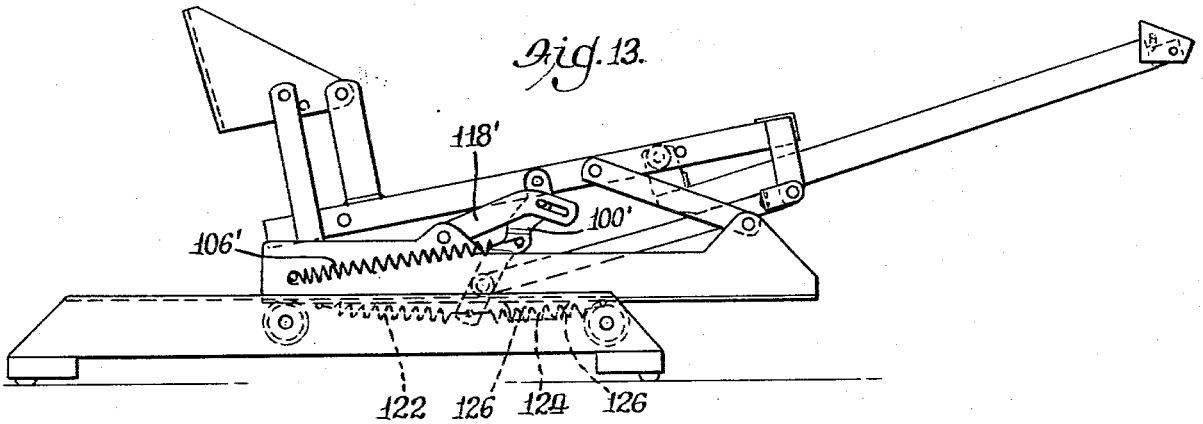
Figure 14:
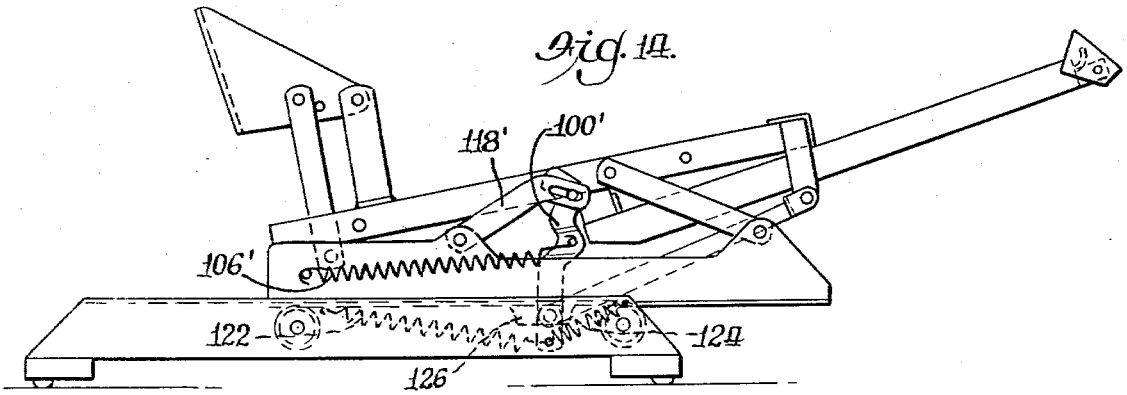

Specifically, in FIGS. 11 to 14, the toggle link 120, which is loaded in tension to propel the chair body forward and in compression during the return trip, is replaced by a pair of wire-coil drafting springs 122 and 124 connected from the end of the drive arm 100 forwardly and rearwardly to the base frame 20, so that the rearward swing of the drive arm under the influence of the main drive spring 106' stretches the forward drafting spring 124 (FIG. 11 to FIG. 12). The drafting springs are lighter and softer than the drive springs 106', with the result that the imbalance between the main drive spring 106' and the forward drafting spring 124 delays the acceleration of the chair body forwardly on the base carriage until the extension of the footrest is accomplished or well under way. A similar delayed-action effect (FIG. 13 to FIG. 14) is achieved in the return of the chair body to the rearward position on the chair base, assuming that the footrest is retracted by the occupant in an equally quick motion. With the drafting spring arrangement of FIGS. 11 to 14, positive stops to limit carriage travel are desirable, and may take the form of a shoe 126 on the bottom of each carriage side plate between the support rollers.

It will also be apparent from the foregoing that if the delay of either or both movements of the chair body as a whole should not be desired, one or both of the drafting springs may be replaced by a flexible link, for example, in the form of a length of chain or cable connected between the end of the drive arm 100 and the base frame. It will further be apparent that the delayed action effect achieved with soft springs between the end of the drive arm and the base frame can also be achieved, notwithstanding the use of a rigid link such as the toggle link 120 of the preferred embodiment, if the pivotal connection of either of the pivots of the toggle link is movably positioned on the toggle link, or on the base frame, under the influence of springs which permit the pivot to move in a manner such as to initially load the springs by the rearward haul of the drive arm 100 for a delayed movement of the entire chair body on the frame.

In the preferred embodiment, however, with a toggle link 120 of fixed length having a fixed pivotal connection to the base frame, an important incidental advantage is obtained by selecting the relative lengths of the toggle link 120 and drive arm 100 in such a way that the toggle joint, i.e., the pivotal connection of the toggle link to the drive arm, is "on center" between the pivot of the toggle link 120 to the base and the pivot of the drive arm 100 to the seat frame of the chair body. In this position, and with the footrest latched in the rearward position, the drive arm 100 is immobilized and, with the toggle link 120, constitutes a bracing strut which secures the entire chair body 22 against forward or rearward movement on the base frame to protect the mechanism from impact damage in shipment.

III. THE EMBODIMENT OF FIGS. 15 AND 16

The embodiment of FIGS. 15 and 16 is in all structural details similar to the preferred embodiment except that the drive spring 106, utilized in the preferred embodiment to propel the carriage forwardly and to extend the footrest, is replaced by the force of gravity, applied as though to the carriage 24'' rather than direct to the footrest extension mechanism.

That is to say, the carriage "track," instead of being level, is sloped downwardly from back to front by lowering the front rollers 40'' and making suitably conforming alteration to the side rails 36'' of the chair base 20'' and to the side plates 46'' of the carriage 24''. The result is similar to the track arrangement of U.S. Pat. No. 4,072,342 earlier referred to, with the rollers and track reversed. The downhill arrangement permits gravity to draw the entire chair body and the occupant forwardly upon the release of the footrest latches 112''. As the carriage 24'' moves forwardly under the effect of gravity, the toggle link 120'' pushes the drive arm 100'' to the rear relative to the seat frame, much as the drive arm 100 of the preferred embodiment was drawn rearwardly by the driving spring 106, absent in the modification of FIGS. 15 and 16. In other respects, the mechanism is the same with the further exception that the toggle formed by the drive arm 100'' and 120'' is preferably dimensioned so that the toggle is not straightened out when the footrest is retracted and the carriage fully rearward on the sloped track, i.e., so as not to impede the folding action of the drive arm 100'' and the toggle link 120'' when the footrest latches are released. If desired, the breaking of the toggle may be assured by the provision of a small spring, not shown, applied either to the drive arm 100'' or the toggle link 120'', or at the joint between them, to assure the prompt folding of the toggle, and thus the extension of the footrest, as the carriage 24'' proceeds downhill.

Conversely, the forceable retraction of the footrest by the occupant draws the drive arm 100'' forward relative to the seat frame 28'', driving the carriage back uphill until the footrest is re-latched.

From the sloped track embodiment of FIGS. 15 and 16, as well as from the preferred embodiment of FIGS. 2 to 10 inclusive, it will be appreciated that the driving force for propelling the carriage forwardly and for extending the footrest may be applied either to the carriage or to the footrest mechanism. If applied to the carriage, gravity may be used as the driving force with the sloped track arrangements of FIGS. 15 and 16, or, in the case of a level track arrangement, by springs interposed between the chair base 20 and the carriage 24 arranged to drive or to draw the carriage forwardly upon the release of the footrest latches. Such spring force might be applied by one or more springs, preferably of the constant force type, connected between a cross rail of the chair base and a cross member of the carriage.

However, the arrangement of FIGS. 2 to 10 inclusive is preferred for the greater versatility provided by the direct drive of the drive arm by the drive spring, i.e., it suitability not only to wall-clearing recliners but to rocker-recliners and non-rocking recliners as well.

The features of the invention believed new and patentable are set forth in the following claims:

What is claimed is:

1. In a wall-clearing reclining chair having a normally stationary base for supporting the chair on a floor; a chair body comprising a seat and backrest supported on an included carriage which is mounted on said base for forward and rearward movement thereon between a rearward upright sitting position and a forward position permitting unobstructed recline of the backrest; and a retractable footrest supported on said chair body for forward and rearward movement thereon between a retracted position and an extended position in front of the seat of the chair:

means further interconnecting the chair body, the footrest, and the base to effect said forward and rearward movement of one of the chair body and the footrest by the corresponding movement of the other, means connected to at least one of said carriage and footrest to store energy upon said rearward movement and to bias them for said forward movement upon the release of said energy, and means operable by the occupant of the chair to release the stored energy to drive the carriage and footrest forward.

2. The mechanism of claim 1 in which the means interconnecting the chair body, the footrest, and the base comprises an arm pivoted on the chair body for swinging movement forwardly and rearwardly thereof, said arm being connected to the base to propel the chair body forwardly and rearwardly on the base by the swing of the arm, said arm being also connected to the footrest to extend the same upon the forward movement of the chair body.

3. The mechanism of claim 2 in which the connection of the arm to the base is a rigid link constituting with said arm a toggle which is fully extended to form a diagonal strut between the base and the chair body when the latter is in said rearward upright sitting position.

4. The mechanism of claim 2 in which the connection of the arm to the base comprises a pair of flexible links extending forwardly and rearwardly from the arm to the base so as to be tensed alternately by the swing of the arm to produce respectively said forward and rearward movement of the chair body on the base.

5. The mechanism of claim 2 in which the energy storing means is a drive spring connected to said arm to propel the footrest forwardly by the action of the drive spring, and the connection of the arm to the base comprises a pair of tension springs extending forwardly and rearwardly from the arm to the base, said tension springs applying a lesser resistive moment to the swing of said arm than the driving moment of said drive spring so as to delay the progress of the forward and rearward movement of the chair body on the base relative to the progress of the corresponding movement of the footrest.

6. The mechanism of claim 1 in which the energy storing means is a drive spring connected to propel the footrest and carriage and to oppose the recline of the backrest, said spring having sufficient force to cause the righting of the backrest by said rearward movement of the footrest.

7. The mechanism of claim 2 in which the energy storing means comprises a drive spring connected to swing said arm and to oppose the recline of the backrest, said spring having sufficient force to cause the righting of the backrest by said rearward movement of the footrest.

8. The mechanism of claim 7 in which the seat moves forward relative to the carriage by the recline of the backrest thereon; the arm depends pivotally from the seat, is connected to extend the footrest by the rearward swing of the arm on the seat, and is connected by at least one link to the base so as to draw the carriage forwardly on the base concurrently with the extension of the footrest; and the drive spring is a tension spring stretched between the arm and the carriage.

9. The mechanism of claim 1 in which the energy storing means is the mounting of the carriage on the chair base for downward movement under the weight of the occupant and chair body coincidentally with the forward movement of the carriage.

10. The mechanism of claim 9 in which the base provides a forwardly and downwardly inclined track and the carriage is roller-mounted thereon.

11. The mechanism of claim 1 in which the reclinable backrest and the retractable footrest are interconnected by a lost-motion interlock in which the lost-motion is taken up both when the backrest is upright and the footrest retracted and when the backrest is reclined and the footrest extended, the lost-motion occurring upon the extension of the footrest from the sitting position without corresponding recline of the backrest and upon the righting of the backrest without corresponding retraction of the footrest, whereby the degree of extension of the footrest governs the attainable degree of recline of the backrest upon the forward movement of the footrest and the degree of recline of the backrest governs the attainable degree of retraction of the footrest.

12. The mechanism of claim 11 in which the seat is movable on the carriage in response to the recline of the backrest, said means interconnecting the chair body, the footrest, and the base comprises an arm pivoted on the seat for swinging movement forwardly and rearwardly thereof, said arm being connected to the base to propel the chair body forwardly and rearwardly on the base by the swing of the arm, said arm being also connected to the footrest to extend the same upon the forward movement of the chair body, and the lost-motion interlock comprises a link pivoted on the carriage and having therein a slot and a pin on said arm, said pin on the arm being confined in the slot in said link.

13. A reclining chair having a seat, a reclinable backrest, a retractable footrest movably mounted thereon for extension from a stowed position on the chair to an extended position in front of the seat of the chair, mechanism for extending and retracting the footrest, energy storing means biasing the footrest to the extended position, means operable by the occupant of the chair to release the energy stored in said biasing means to extend the footrest, and a lost-motion interlocking connection between the backrest and the mechanism for extending and retracting the footrest in which the lost motion is taken up both when the backrest is upright and the footrest retracted and when the backrest is reclined and the footrest extended, the lost motion occurring upon the extension of the footrest from the sitting position without corresponding recline of the backrest and upon the righting of the backrest without corresponding retraction of the footrest, whereby the degree of extension of the footrest governs the attainable degree of recline of the backrest upon the forward movement of the footrest and the degree of recline of the backrest governs the attainable degree of retraction of the footrest.

14. A reclining chair having a seat, a backrest, a retractable footrest movably mounted on the chair for extension from a stowed position thereon to an extended position in front of the seat, mechanism for extending and retracting the footrest, spring means biasing the footrest to the extended position, means normally restraining the operation of said spring means to extend the footrest, and means operable by the occupant of the chair to disable the restraining means, said spring means being also connected to oppose the recline of the backrest and having sufficient force to prevent substantial recline of the backrest until the spring means are relaxed by the extension of the footrest, said spring means serving as a sequencing interlock to require the extension of the footrest before the recline of the backrest and the righting of the backrest before the retraction of the footrest.

15. In a footrest mechanism for a chair or the like in which the footrest is carried on the front of a carriage comprising a pair of substantially parallel rails supported on the chair for endwise movement forwardly and rearwardly of the chair to extend and retract the footrest, the improvement comprising a drive mechanism for extending the footrest comprising an elongated flexible element connected to said carriage rearwardly thereon and passed around a pulley journalled on said chair near the front thereof, a second pulley movable mounted on the chair rearwardly of the first mentioned pulley, said flexible element being passed around said second pulley and anchored to the chair, said second pulley being movable to pull the flexible element around the first mentioned pulley to draw said carriage and footrest forwardly, and means on the chair for so moving said second pulley.

16. The improvement of claim 15 wherein the means for moving the second pulley includes a spring connected to the chair and to said second pulley so as to be loaded by the retraction of the footrest, latch means normally preventing the forward movement of the footrest, and means operable by the occupant of the chair to disable the latch means.

17. The mechanism of claim 1 wherein the energy storing means includes a latch which normally prevents said forward movement of the carriage and footrest, and said energy-releasing means operates to disable said latch.

18. The improvement of claim 16 wherein the means on said chair for moving said second pulley comprises an arm pivoted to the chair and having said second pulley journalled thereon.

* * * * *

UNITED STATES PATENT AND TRADEMARK OFFICE

CERTIFICATE OF CORRECTION

PATENT NO. : 4,226,468

DATED : October 7, 1980

INVENTOR(S) : Carl B. Johnson

It is certified that error appears in the above-identified patent and that said Letters Patent are hereby corrected as shown below:

In Column 14, line 27 (Claim 15, line 10 thereof), the word "movable" should read --movably--.

Signed and Sealed this

*Twenty-seventh* Day of *January 1981*

[SEAL]

*Attest:*

RENE D. TEGTMEYER

*Attesting Officer*

*Acting Commissioner of Patents and Trademarks*